US006539655B1

(12) United States Patent
Earle

(10) Patent No.: US 6,539,655 B1
(45) Date of Patent: Apr. 1, 2003

(54) HOLIDAY DISPLAY

(76) Inventor: Paula Earle, 1127 Alps Rd., Wayne, NJ (US) 07470

( * ) Notice: Subject to any disclaimer, the term of this patent is extended or adjusted under 35 U.S.C. 154(b) by 146 days.

(21) Appl. No.: 09/680,730

(22) Filed: Oct. 6, 2000

(51) Int. Cl.[7] ..... G09F 19/08; A41H 5/00

(52) U.S. Cl. ..... 40/419; 40/538; D20/31; 223/66; 428/7

(58) Field of Search ..... 40/538, 419, 411; 223/68, 66; D20/31, 32; 428/7, 8, 9; D11/160, 150, 128, 129

(56) References Cited

U.S. PATENT DOCUMENTS 1,537,484 A * 5/1925 Meehan ..... 40/419
D181,549 S * 11/1957 Robinson ..... D20/31
3,672,097 A * 6/1972 Gardel et al. ..... 40/418
4,801,285 A * 1/1989 Yeu ..... 446/298
D375,527 S * 11/1996 Keogh ..... D20/31

* cited by examiner

*Primary Examiner*—Cassandra H. Davis
(74) *Attorney, Agent, or Firm*—Goldstein & Lavas, P.C.

(57) ABSTRACT

A holiday display including a base portion including a body portion having an upper end, a lower end, and side walls extending therebetween. The base portion includes a pair of arms extending outwardly from the upper end of the body portion. The base portion includes a head portion swively secured to the upper end of the body portion. An outer decorative portion is provided that is adapted for removably covering the base portion.

3 Claims, 4 Drawing Sheets

HOLIDAY DISPLAY

BACKGROUND OF THE INVENTION

The present invention relates to a holiday display and more particularly pertains to presenting a real-life human display for decorating one's property during the holidays.

Typical holiday displays are usually quite ornate and generally do not appear very life like. People who adorn their properties and homes with these types of holiday displays are usually left with a somewhat tacky result. These adornments always include plastic Santa Claus' for Christmas, paper cut out witches for Halloween, etc. What is needed is decorations that appear more life like as well as accentuate the appearance of the front of one's home.

The present invention attempts to solve the abovementioned problem by providing a display that can be easily constructed and easily changed for different holidays.

The use of figure support devices is known in the prior art. More specifically, figure support devices heretofore devised and utilized for the purpose of supporting inanimate figures for display are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,549,499 to Foskey discloses a doll stand comprised of a base, an upstanding rod and a clamp assembly. U.S. Pat. No. 5,342,234 to Bloom and U.S. Pat. No. 5,551,656 to De Lozada disclose additional support devices for figures.

While these devices fulfill their respective, particular objective and requirements, the aforementioned patents do not describe a holiday display for presenting a real-life human display for decorating one's property during the holidays.

In this respect, the holiday display according to the present invention substantially departs from the conventional concepts and designs of the prior art, and in doing so provides an apparatus primarily developed for the purpose of presenting a real-life human display for decorating one's property during the holidays.

Therefore, it can be appreciated that there exists a continuing need for a new and improved holiday display which can be used for presenting a real-life human display for decorating one's property during the holidays. In this regard, the present invention substantially fulfills this need.

SUMMARY OF THE INVENTION

In the view of the foregoing disadvantages inherent in the known types of figure support devices now present in the prior art, the present invention provides an improved holiday display. As such, the general purpose of the present invention, which will be described subsequently in greater detail, is to provide a new and improved holiday display, which has all the advantages of the prior art and none of the disadvantages.

To attain this, the present invention essentially comprises a base portion including a body portion having a narrow upper end, a wide lower end, and side walls extending therebetween. The base portion includes a pair of arms extending outwardly from the upper end of the body portion. The pair of arms each include a fixed upper portion and a pivotable lower portion. The base portion includes a head portion swively secured to the upper end of the body portion.

The head portion includes a platform rotatably coupled with the upper end of the body portion. An outer decorative portion is provided that is adapted for removably covering the base portion. The outer decorative portion includes a body section for covering the body portion and pair of arms of the base portion. The outer decorative portion includes a mask portion for covering the head portion of the base portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved holiday display, which has all the advantages of the prior art figure support devices and none of the disadvantages.

It is another object of the present invention to provide a new and improved holiday display, which may be easily and efficiently manufactured and marketed.

It is a further object of the present invention to provide a new and improved holiday display, which is of durable and reliable construction.

An even further object of the present invention is to provide a new and improved holiday display which is susceptible of a low cost of manufacture with regard to both materials and labor, and which accordingly is then susceptible of low prices of sale to the consuming public, thereby making such holiday display economically available to the buying public.

Even still another object of the present invention is to provide a new and improved holiday display for presenting a real-life human display for decorating one's property during the holidays.

Lastly, it is an object of the present invention to provide a new and improved holiday display including a base portion including a body portion having an upper end, a lower end, and side walls extending therebetween. The base portion includes a pair of arms extending outwardly from the upper end of the body portion. The base portion includes a head portion swively secured to the upper end of the body portion. An outer decorative portion is provided that is adapted for removably covering the base portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
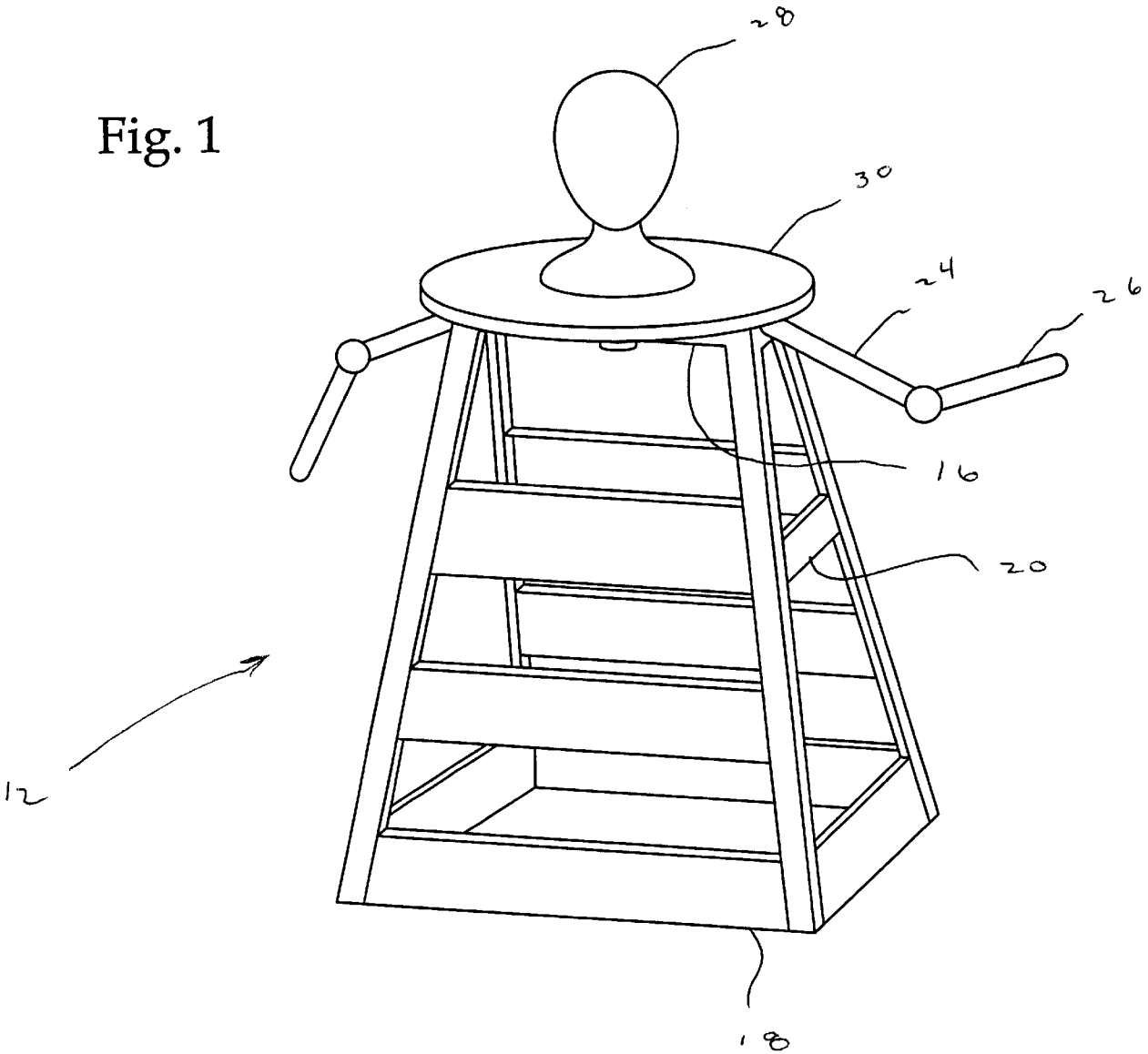
FIG. 1 is a perspective view of the preferred embodiment of the holiday display constructed in accordance with the principles of the present invention.
Figure 2:
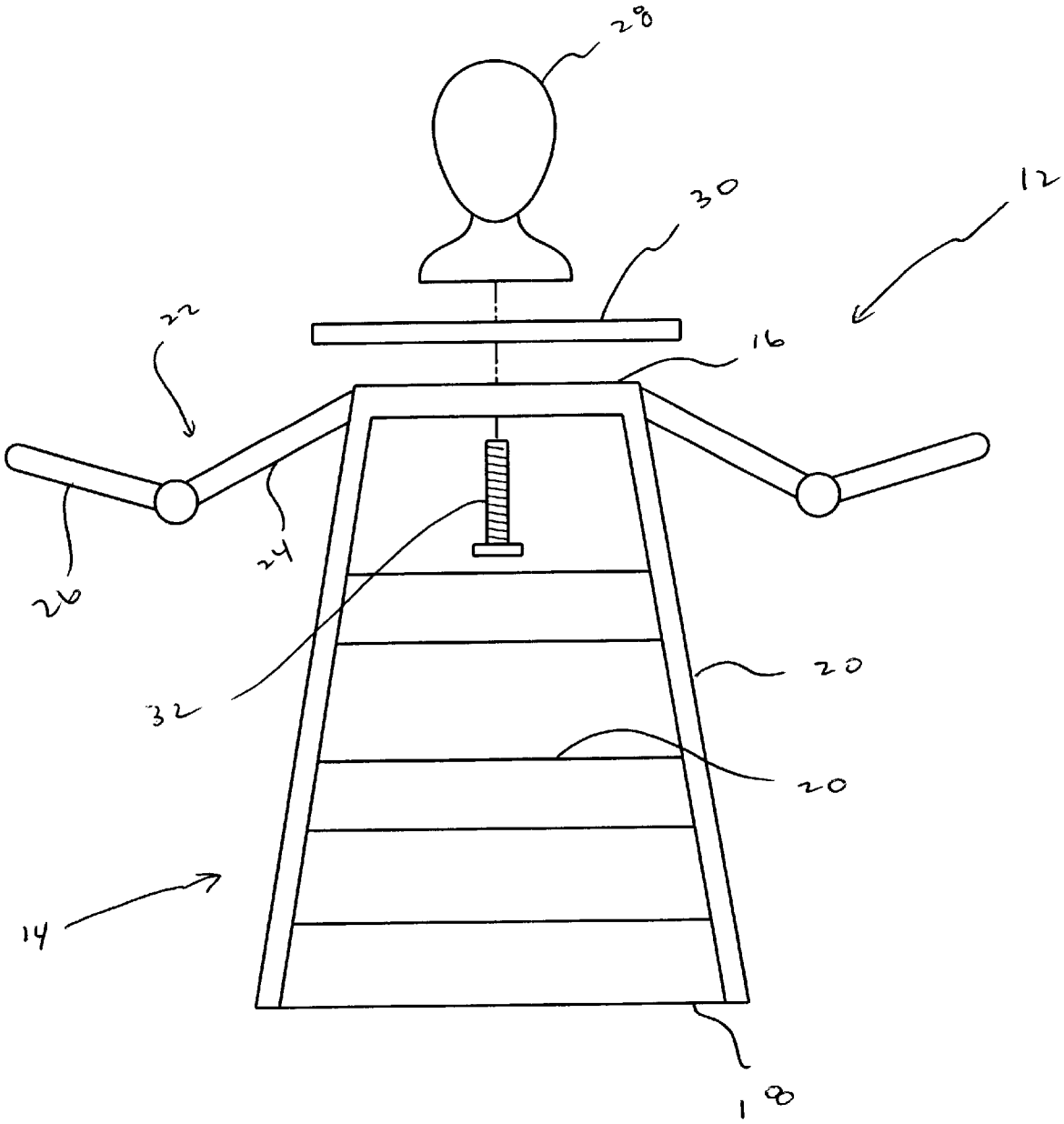
FIG. 2 is a front view of the base portion of the present invention.
Figure 3:
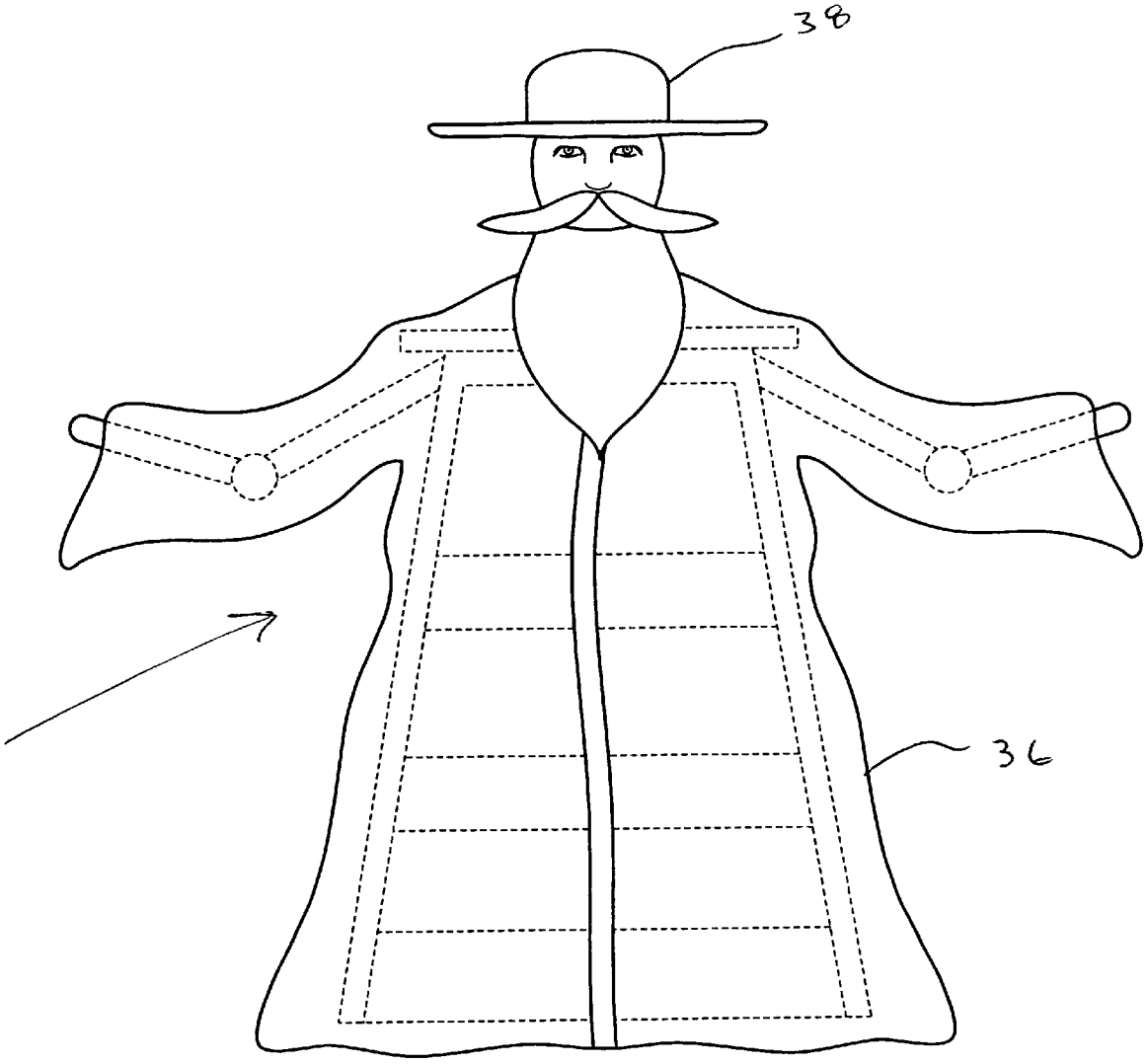
FIG. 3 is a front view of the present invention illustrated with the outer decorative portion in place over the base portion thereof.
Figure 4:
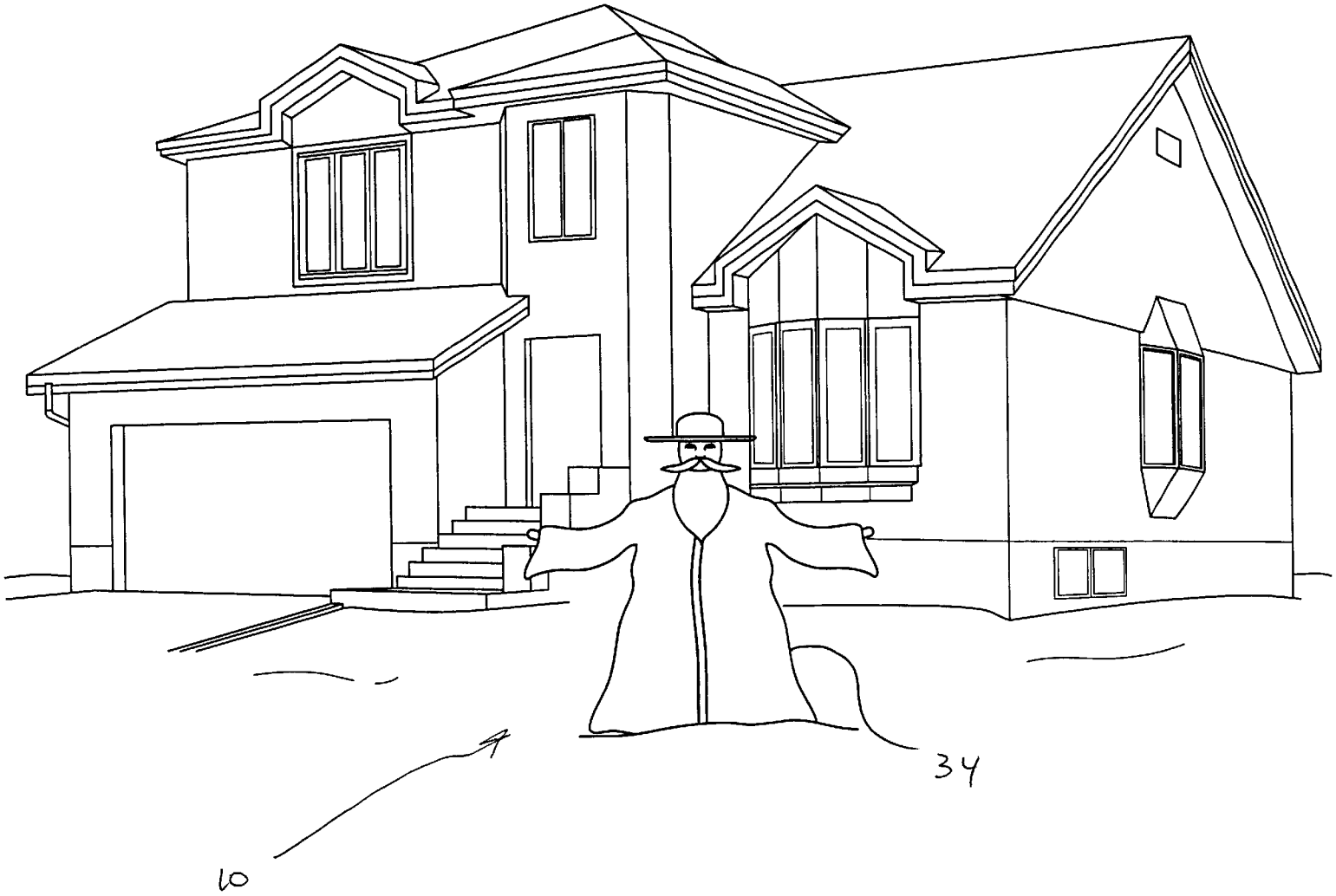
FIG. 4 is a front view of the present invention illustrated in use.

With reference now to the drawings, and in particular, to FIGS. 1 through 4 thereof, the preferred embodiment of the new and improved holiday display embodying the principles and concepts of the present invention and generally designated by the reference number 10 will be described.

Specifically, it will be noted in the various Figures that the device relates to a holiday display for presenting a real-life human display for decorating one's property during the holidays.

In its broadest context, the device consists of a base portion and an outer decorative portion. Such components are individually configured and correlated with respect to each other so as to attain the desired objective.

The base portion 12 includes a body portion 14 having a narrow upper end 16, a wide lower end 18, and side walls 20 extending therebetween. The configuration of the body portion 14 is important so as to stabilize the device 10 when in use. The sidewalls 20 are preferably comprised of two or more crossbars. The base portion 12 includes a pair of arms 22 extending outwardly from the upper end 16 of the body portion 14. The pair of arms 22 each include a fixed upper portion 24 and a pivotable lower portion 26. The arrangement of the arms 22 allows for their positioning to being altered as needed. The base portion 12 includes a head portion 28 swively secured to the upper end 16 of the body portion 12. The head portion 28 includes a platform 30 rotatably coupled with the upper end 16 of the body portion 14. The platform 30 is coupled with the upper end 16 by a single bolt 32.

The outer decorative portion 34 is adapted for removably covering the base portion 12. The outer decorative portion 34 includes a body section 36 for covering the body portion 14 and pair of arms 22 of the base portion 12. The outer decorative portion 34 includes a mask portion 38 for covering the head portion 28 of the base portion 12. The outer decorative portion 34 will resemble clothing that would be typical for the season. The body section 36 will preferably be loose fitting so that is would move when affected by the weather. The outer decorative portion 34 can be made in any style and color to resemble the desired holiday character.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be pretected by Letters Patent of the United States is as follows:

1. A holiday display for presenting a real-life human display for decorating one's property during the holidays comprising, in combination:

a base portion including a body portion having a narrow upper end, a wide lower end, and side walls extending therebetween, the base portion including a pair of arms extending outwardly from the upper end of the body portion, the pair of arms each including a fixed upper portion and a pivotable lower portion, the base portion including a head portion swively secured to the upper end of the body portion, the head portion including a platform rotatably coupled with the upper end of the body portion; and an outer decorative portion adapted for removably covering the base portion, the outer decorative portion including a body section for covering the body portion and pair of arms of the base portion, the outer decorative portion including a mask portion for covering the head portion of the base portion.

2. A holiday display for presenting a real-life human display for decorating one's property during the holidays comprising, in combination:

a base portion including a body portion having an upper end, a lower end, and side walls extending therebetween, the base portion including a pair of arms extending outwardly from the upper end of the body portion, the base portion including a head portion swively secured to the upper end of the body portion, the head portion including a platform rotatably coupled with the upper end of the body portion; and an outer decorative portion adapted for removably covering the base portion.

3. A holiday display for presenting a real-life human display for decorating one's property during the holidays comprising, in combination:

a base portion including a body portion having an upper end, a lower end, and side walls extending therebetween, the base portion including a pair of arms extending outwardly from the upper end of the body portion, the base portion including a head portion swively secured to the upper end of the body portion; and an outer decorative portion adapted for removably covering the base portion, the outer decorative portion including a body section for covering the body portion and pair of arms of the base portion, the outer decorative portion including a mask portion for covering the head portion of the base portion.

* * * * *

UNITED STATES PATENT AND TRADEMARK OFFICE

CERTIFICATE OF CORRECTION

PATENT NO. : 6,539,655 B1
DATED : April 1, 2003
INVENTOR(S) : Marcos Llona

It is certified that error appears in the above-identified patent and that said Letters Patent is hereby corrected as shown below:

Column 6,
Line 10, delete “conformably” and insert -- conformally --
Line 21, delete “all” and insert -- an -- therefor.

Signed and Sealed this

Fifteenth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,539,655 B1
DATED : April 1, 2003
INVENTOR(S) : Paula Earle

It is certified that error appears in the above-identified patent and that said Letters Patent is hereby corrected as shown below:

This certificate supersedes Certificate of Correction issued June 15, 2004, the number was erroneously mentioned and should be vacated since no Certificate of Correction was granted.

Signed and Sealed this

Twentieth Day of July, 2004

JON W. DUDAS
*Acting Director of the United States Patent and Trademark Office*